US009118989B2

(12) United States Patent
Zukowski

(10) Patent No.: US 9,118,989 B2
(45) Date of Patent: Aug. 25, 2015

(54) NOISE MITIGATING MICROPHONE ATTACHMENT

(71) Applicant: Kaotica Corporation, Corporation #2015091974, Calgary (CA)

(72) Inventor: Konrad Zukowski, Calgary (CA)

(73) Assignee: Kaotica Corporation, Calgary (CA)

( * ) Notice: Subject to any disclaimer, the term of this patent is extended or adjusted under 35 U.S.C. 154(b) by 0 days.

(21) Appl. No.: 13/766,371

(22) Filed: Feb. 13, 2013

(65) Prior Publication Data

US 2014/0064544 A1 Mar. 6, 2014

Related U.S. Application Data

(63) Continuation-in-part of application No. 13/604,589, filed on Sep. 5, 2012, now Pat. No. 8,737,662.

(51) Int. Cl.

| | |
|---|---|
| ***H04R 9/08*** | (2006.01) |
| ***H04R 1/02*** | (2006.01) |
| ***H04R 1/08*** | (2006.01) |
| ***H04R 1/34*** | (2006.01) |

(52) U.S. Cl.

CPC ..... *H04R 1/02* (2013.01); *H04R 1/083* (2013.01); *H04R 1/086* (2013.01); *H04R 1/342* (2013.01); *H04R 1/025* (2013.01)

(58) Field of Classification Search

USPC ..... 381/355, 386

See application file for complete search history.

(56) References Cited

U.S. PATENT DOCUMENTS

| | | | |
|---|---|---|---|
| D49,555 | S | 8/1916 | Vivaudou |
| D69,766 | S | 3/1926 | Miller |
| D112,545 | S | 12/1938 | Younghusband |
| 2,263,408 | A | 11/1941 | Lakhovsky |
| 2,881,850 | A | 4/1959 | Bonn |

(Continued)

FOREIGN PATENT DOCUMENTS

| | | | |
|---|---|---|---|
| EP | 2330829 | A1 | 6/2011 |
| WO | 99/49697 | A1 | 9/1999 |
| WO | 2009/134519 | A1 | 11/2009 |

OTHER PUBLICATIONS

Office Action mailed Oct. 21, 2013 in U.S. Appl. No. 13/604,589, 9 pages.

(Continued)

*Primary Examiner* — Davetta W Goins
*Assistant Examiner* — Amir Etesam
(74) *Attorney, Agent, or Firm* — Kilpatrick Townsend & Stockton LLP

(57) ABSTRACT

Methods, systems and apparatus are described for mitigating noise during sound recording. A noise mitigating microphone attachment comprises a foam structure. A first cavity extending from a first opening at a surface of the foam structure and into the foam structure. A microphone is inserted into the first cavity with sound receiving elements of the microphone fully installed in the structure. A second cavity extending from a second opening at the surface of the foam structure and into the foam structure is configured to receive sound from a sound source. The first cavity is fluidly connected to the second cavity within the foam structure so that a junction is formed between the first cavity and the second cavity. The junction, the sound cavity, and the sealing of the microphone work to shield the sound receiving elements of the microphone from sound other than received through the second opening.

16 Claims, 6 Drawing Sheets

(56) References Cited

U.S. PATENT DOCUMENTS

| | | | | |
|---|---|---|---|---|
| D186,892 | S | 12/1959 | Wilber | |
| D210,538 | S | 3/1968 | Lahti | |
| 3,440,365 | A | 4/1969 | Bryant et al. | |
| 3,573,400 | A | 4/1971 | Sessler | |
| D222,072 | S | 9/1971 | Millburn | |
| 3,895,188 | A | 7/1975 | Ingraham | |
| D254,716 | S | 4/1980 | Mascia et al. | |
| D264,994 | S | 6/1982 | Rippley | |
| D272,128 | S | 1/1984 | Parmentier | |
| 4,570,746 | A | 2/1986 | Das et al. | |
| D286,858 | S | 11/1986 | Giorgio | |
| D291,179 | S | 8/1987 | Frizon | |
| 4,703,872 | A | 11/1987 | Cornette et al. | |
| 4,792,013 | A | 12/1988 | Boynton | |
| 4,805,728 | A | 2/1989 | Carter et al. | |
| 4,834,212 | A | 5/1989 | Figone et al. | |
| 4,953,223 | A | 8/1990 | Householder | |
| 4,967,874 | A | 11/1990 | Scalli | |
| 5,022,486 | A | 6/1991 | Miura et al. | |
| 5,309,808 | A | 5/1994 | Tarrant | |
| 5,395,168 | A | 3/1995 | Leenen | |
| 5,692,060 | A | 11/1997 | Wickstrom | |
| D395,715 | S | 6/1998 | Queen | |
| D404,681 | S | 1/1999 | Galerneau | |
| D430,142 | S | 8/2000 | Kuo et al. | |
| D445,831 | S | 7/2001 | Lindner | |
| D447,471 | S | 9/2001 | Andre et al. | |
| D460,952 | S | 7/2002 | Kataoka | |
| D464,571 | S | 10/2002 | Hill et al. | |
| D487,739 | S | 3/2004 | Wise | |
| 6,738,487 | B1 | 5/2004 | Nageno et al. | |
| 6,968,053 | B1 | 11/2005 | Ray | |
| 6,991,289 | B2 * | 1/2006 | House | 297/217.4 |
| D519,112 | S | 4/2006 | Yang | |
| D525,375 | S | 7/2006 | Funck et al. | |
| D526,644 | S | 8/2006 | Breit | |
| D528,257 | S | 9/2006 | Leclerc et al. | |
| D534,814 | S | 1/2007 | Johnston et al. | |
| D552,084 | S | 10/2007 | Chapman et al. | |
| D554,682 | S | 11/2007 | Martinez et al. | |
| D564,900 | S | 3/2008 | Green et al. | |
| D566,189 | S | 4/2008 | Ivey | |
| 7,496,208 | B2 | 2/2009 | Uchimura | |
| D588,583 | S | 3/2009 | McDougal | |
| D592,064 | S | 5/2009 | Kilany | |
| D596,306 | S | 7/2009 | Levine | |
| D596,616 | S | 7/2009 | Andre et al. | |
| D602,311 | S | 10/2009 | Finell | |
| D612,245 | S | 3/2010 | Canamasas | |
| D618,209 | S | 6/2010 | Andre et al. | |
| D618,210 | S | 6/2010 | Andre et al. | |
| 7,747,033 | B2 | 6/2010 | Uchimura | |
| 7,783,069 | B1 | 8/2010 | Miller et al. | |
| 7,840,013 | B2 | 11/2010 | Dedieu et al. | |
| D631,204 | S | 1/2011 | Dubitsky et al. | |
| 7,916,887 | B2 | 3/2011 | Cleckler et al. | |
| D640,248 | S | 6/2011 | Baumann et al. | |
| D645,846 | S | 9/2011 | Mordechai | |
| D650,280 | S | 12/2011 | De Peyerimhoff et al. | |
| 8,069,946 | B1 | 12/2011 | Cruise, III | |
| D661,540 | S | 6/2012 | Facey | |
| D661,994 | S | 6/2012 | Van Den Wouwer et al. | |
| D674,103 | S | 1/2013 | Smith | |
| D675,194 | S | 1/2013 | Andre | |
| D676,423 | S | 2/2013 | Joseph | |
| 8,430,258 | B2 | 4/2013 | Yamamoto | |
| D690,344 | S | 9/2013 | Hollinger | |
| D693,814 | S | 11/2013 | Park | |
| D696,298 | S | 12/2013 | Britt et al. | |
| D698,023 | S | 1/2014 | Iseberg et al. | |
| D699,674 | S | 2/2014 | Man | |
| D700,591 | S | 3/2014 | Xiao et al. | |
| D701,831 | S | 4/2014 | Park et al. | |
| D705,844 | S | 5/2014 | Bart et al. | |
| 8,730,037 | B2 * | 5/2014 | Houvener et al. | 340/540 |
| 8,737,662 | B2 | 5/2014 | Zukowski | |
| 2005/0126848 | A1 | 6/2005 | Siavoshai et al. | |
| 2008/0302599 | A1 | 12/2008 | Zou | |
| 2009/0202097 | A1 | 8/2009 | Tiscareno et al. | |
| 2014/0061077 | A1 | 3/2014 | Guttag et al. | |
| 2014/0064543 | A1 | 3/2014 | Zukowski | |
| 2014/0064544 | A1 | 3/2014 | Zukowski | |

OTHER PUBLICATIONS

International Search Report and Written Opinion mailed Oct. 28, 2013 in PCT/CA2013/050674, 8 pages.

Office Action mailed Aug. 18, 2014 in Design U.S. Appl. No. 29/471,259, 9 pages.

Office Action mailed Nov. 6, 2014 in U.S. Appl. No. 29/471,259, 11 pages.

U.S. Appl. No. 29/471,259, Notice of Allowance mailed May 26, 2015.

* cited by examiner

NOISE MITIGATING MICROPHONE ATTACHMENT

CROSS-REFERENCES TO RELATED APPLICATIONS

The present application is a continuation-in-part application of and claims priority to U.S. patent application Ser. No. 13/604,589, filed Sep. 5, 2012, the entire contents of which are herein incorporated by reference for all purposes.

BACKGROUND

When a microphone is used to record a performance in a space that has not been treated for sound recording, sound that is unrelated to the performance may be picked up by the microphone. Ambient noise or "room tone" can include noise originating within the space, such as the sound of an air conditioner or computer fan in the room. Noise entering the space from the exterior, such as traffic noise, may also contribute to ambient noise levels. Ambient noise that is picked up by a microphone during the recording of a performance can detract from the quality of the recording.

Additionally, performance sound can be reflected from interior surfaces of the space, such as walls, ceiling, floor, furniture, etc. When the reflected sound waves arrive at the microphone, the reflected sound waves may be out of phase with the sound waves traveling directly from the performer to the microphone. These reflected sound waves may be picked up by the microphone as a muddled version or echo of the performance.

Because of these issues, performances are often recorded in a room that is specially treated for sound recording. For example, the interior surfaces of the room may be treated with sound absorbing materials to reduce reflections of performance sound within the room. The windows and doors of the room may be reinforced or constructed from materials designed to reduce the intrusion of exterior noise into the space. Additional measures may be taken to reduce machine noise in the room. Such measures can make treating a room for sound recording a costly and complicated endeavor. Moreover, when sound recording occurs within a home, it may be undesirable to alter the appearance of the room as needed to accommodate sound recording.

Portable sound recording booths may be set up within a room that is not treated for sound recording. The portable sound recording booth may have walls and a ceiling treated with sound absorbing material to reduce the amount of reflected sound picked up by a microphone. The booth may be costly, require a complicated assembly process and, when assembled, can occupy a substantial amount of space within a room.

Embodiments of the invention solve these and other problems.

BRIEF SUMMARY

Methods and apparatus are described for mitigating noise with a portable microphone attachment.

According to one embodiment, an attachment for a microphone comprises a foam structure. A first cavity extends from a first opening at a surface of the foam structure and into the foam structure. The first cavity is configured to seal a mobile device at least partly in the cavity. The attachment also has a second cavity extending from a second opening at the surface of the foam structure and into the foam structure. The second opening receives sound from a sound source. The first cavity is fluidly connected to the second cavity within the foam structure so that a junction is formed between the first cavity, the second cavity, and the sealing of the mobile device. The junction works to shield the sound receiving elements of a microphone coupled to the mobile device from sound other than the sound received through the second opening.

In a another embodiment, a method for mitigating noise comprises receiving a mobile device through a first opening of a foam structure into a first cavity in the foam structure. A microphone coupled to the mobile device extends into a second cavity in the foam structure. The second cavity is fluidly connected to the first cavity within the foam structure and extends from a second opening at a surface of the foam structure. Performance sound is received from a performance sound source via the second cavity. Sound waves incident on an exterior surface of the second cavity are attenuated by the foam structure.

To better understand the nature and advantages of the present invention, reference should be made to the following description and the accompanying figures. It is to be understood, however, that each of the figures is provided for the purpose of illustration only and is not intended as a definition of the limits of the scope of the present invention.

DETAILED DESCRIPTION

Embodiments of the present invention relate to mitigating noise during a capture of sound recording with a noise mitigating microphone attachment. Noise can refer to any unwanted sound, i.e., sound that is not desirable to have a microphone detect during a recording. For example, it may be desirable that noise such as ambient noise and reflections of sound waves originating from a performance sound source is mitigated. The noise mitigating microphone attachment can reduce the amount of noise that a microphone will pick up during a sound recording.

The noise mitigating microphone attachment is typically a foam structure, such as a foam sphere. The noise mitigating microphone attachment can have two openings. A microphone can be inserted through one of the openings into a first hollow cavity ("microphone cavity") within the foam structure. The second opening may be placed proximate to a sound source, such as a vocalist or an instrument. Sound radiating from the sound source travels through the second opening into a second hollow cavity ("sound cavity"). The microphone cavity and the sound cavity can intersect, allowing sound from the sound source to travel to the microphone via the sound cavity. In some embodiments, the microphone can extend through the microphone cavity into the sound cavity. In other embodiments, the microphone may be coupled to a mobile device that extends through the microphone cavity into the sound cavity.

In some embodiments, a microphone coupled to a mobile device is used with the noise mitigating microphone attachment. Where the term "microphone" is used herein, a mobile device or other device having a microphone attachment may be used. For example, a mobile device can extend through the microphone cavity such that a microphone connected to the mobile device extends into the sound cavity.

The microphone can be attached to the foam structure by an elastic coupling between the microphone and the foam structure. The elastic coupling may form a seal around the casing of microphone. The seal can reduce the amount of noise that enters the sound cavity through the microphone cavity.

The structure (e.g., foam) surrounding the sound cavity can be a sound attenuating material for attenuating sound waves incident on the exterior surface of the sound cavity, such that sound waves traveling through the structure into the sound cavity are attenuated. In some embodiments, the structure can absorb sound incident on the exterior surface of the noise mitigating microphone attachment. The structure may additionally attenuate sound waves incident on the interior surface of the sound cavity, such that sound waves traveling through the structure from the sound cavity to the exterior of the structure are attenuated. The structure can further absorb noise incident on the interior surface of the sound cavity. Performance sound received at the opening into the sound cavity can be channeled along the sound cavity to the microphone.

Figure 1:
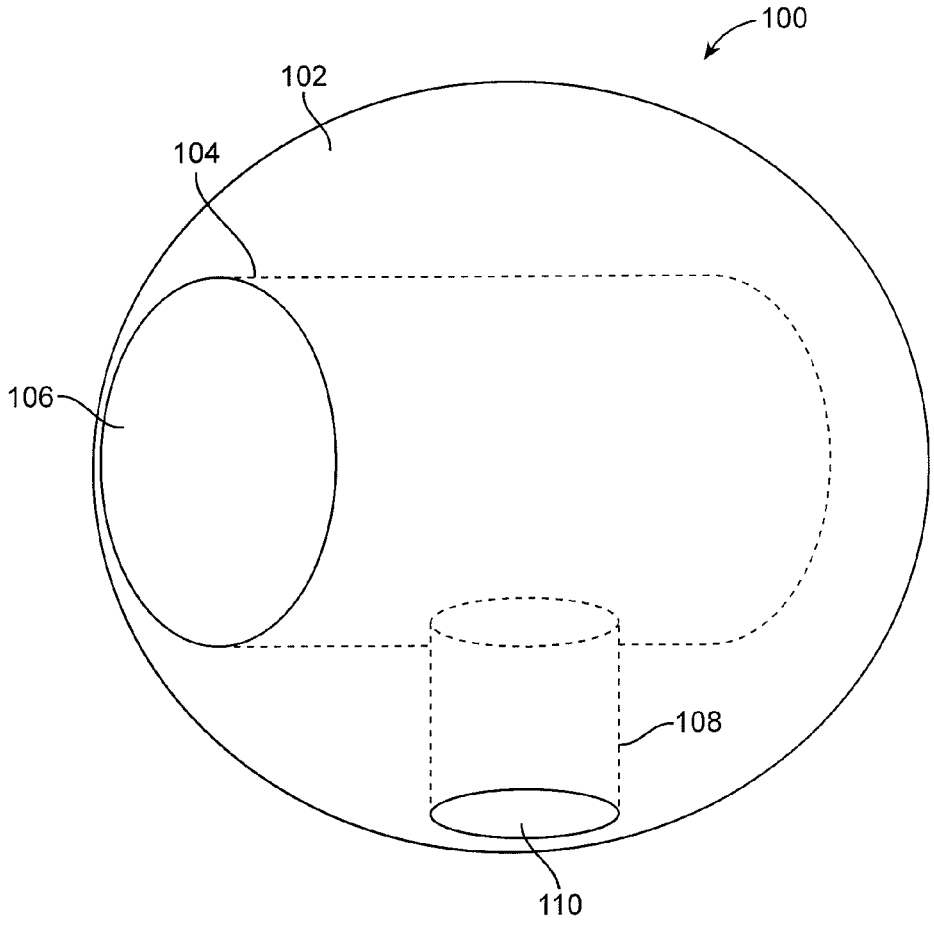
FIG. 1 shows an illustrative noise mitigating microphone attachment, according to an embodiment.

FIG. 1 shows a side view of a noise mitigating microphone attachment according to an embodiment. Noise mitigating microphone attachment 100 can include structure 102 having a sound cavity 104 and a microphone cavity 108. In some embodiments, structure 102 is a foam having sound absorbing properties. For example, structure 102 may be polyurethane foam, such as an open cell polyurethane foam. The foam may have an Indentation Force Deflection (IFD) at 25% deflection between 40 and 150 pounds per 50 square inches (lb./50 in.$^2$), such as 65 to 70 lb./50 in.$^2$, e.g., 70 lb./50 in.$^2$. The foam may have a density threshold between 1.5 and 3.5 pounds per cubic foot (PCF), such as 2.45-2.65 PCF, e.g., 2.5 PCF. Polyurethane foam may be fabricated in a mold. The foam can be fabricated with an integral skin or may be fabricated or modified to have no integral skin. In a preferred embodiment, the foam has no integral skin.

Structure 102 may have a spherical shape. The spherical shape can allow the noise mitigating microphone attachment to be supported within a shock mount, as described further below. Polyurethane foam may experience discoloration over time, and such discoloration may be relatively inconspicuous on a form having a spherical shape (compared with other shapes) due to even exposure of the sphere's surface to air. Structure 102 may be a sphere having a diameter in the range of 2 inches to 36 inches, such as 4 inches to 12 inches, e.g. 7.6 inches. The spherical shape may also facilitate seating of the noise mitigating microphone attachment within a shock mount. This allows the noise mitigating microphone attachment to be used with a microphone mounted to a microphone stand with a shock mount.

Sound cavity 104 may extend from an opening 106 at the surface of structure 102. In some embodiments, sound cavity 104 has a cylindrical shape. A cylindrical shape can allow even absorption and/or reflection of sound around the circumference and along the interior of sound cavity 104. It will be understood that due to sound absorbing characteristics of the material of which structure 102 may be composed, reflection of sound occurring within sound cavity 104 may be low or negligible. Sound cavity 104 may have a diameter in the range of 1 inch to 12 inches, such as 4 inches to 5 inches, e.g. 4¼ inches. Sound cavity 104 may have a length in the range of 3 inches to 15 inches, such as 5 inches to 6 inches, e.g. 5½ inches. The distance from sound cavity 104 to the outer surface of structure 102 may be in the range of 1 inch to 6 inches, such as 1½" to 3 inches, e.g., 2 inches.

Microphone cavity 108 may extend from an opening 110 at the surface of structure 102 and may intersect sound cavity 104. In some embodiments, microphone cavity 108 has a cylindrical shape. A cylindrical shape can allow microphone cavity 108 to accommodate microphones having a variety of casings, such as cylindrical casings, rectangular casings, etc. A microphone may be inserted into microphone cavity 108 via opening 110. The microphone may extend through microphone cavity 108 into sound cavity 104. Microphone cavity 108 may have a diameter in the range of ⅛ inch to 3 inches, such as 1 inch to 2 inches, e.g. 1¾ inches. Microphone cavity 108 may have a length in the range of 1 inch to 8 inches, such as 1½ inches to 3 inches, e.g. 2 inches.

In some embodiments, microphone cavity 108 may have a rectangular, square, ovoid, or other non-circular cross section to receive a microphone, mobile device, or other device having a non-circular cross section. For example, a microphone used with microphone attachment 100 may be coupled to a mobile device, such as a cellular phone, having a rectangular cross section. Microphone cavity 108 may have a rectangular cross-sectional area configured to receive a mobile device that has a rectangular cross-sectional area. When the mobile device is inserted into microphone cavity 108, microphone cavity 108 may seal the mobile device into the cavity. Alternatively, a converter insert, such as a circular-profile-to-rectangular-profile converter insert may be inserted into microphone cavity 108 to accommodate a microphone, mobile device, or other device having a cross sectional area that differs from the cross-sectional area of microphone cavity 108. The converter insert may include one or more pieces of foam material. When inserted into microphone cavity 108 along with a device, the converter insert can seal the device within microphone cavity 108.

In another embodiment, microphone attachment 100 may have a slit or hole in lieu of microphone cavity 108. For example, the slit or hole may be just large enough to allow a cable, such as a microphone cable, to pass from the exterior of microphone attachment 100 to a microphone or mobile device that is fully or partially located in sound cavity 104. A slit used in lieu of microphone cavity 108 may be located at the position of opening 110. Alternatively, the slit may be located opposite opening 106, such that a cable passing through the slit to the microphone is parallel to the longitudinal axis of sound cavity 104.

The microphone can be located at a distance from opening 106, such a distance in a range of 1 inch to 8 inches, such as 1½ inches to 4 inches e.g., 2½ inches. The microphone can also be located at a distance from the end of sound cavity opposing opening 106, such as a distance in a range of 1 inch to 8 inches, such as 2 to 5 inches, e.g., 3 inches. Locating the microphone at a distance from opening 106 allows noise entering sound cavity 104 to interact with absorptive interior surface of sound cavity 104 before arriving at a microphone in microphone cavity 108. For example, the noise may enter sound cavity at an angle such that it is absorbed by the interior surface of sound cavity 104. Sound cavity 104 may have a minimal effect on performance sound travelling directly from the performance sound source to the microphone.

Sound cavity 104 and microphone cavity 108 may be oriented at a variety of angles with respect to one another. For example, the longitudinal axis of sound cavity 104 and the longitudinal axis of microphone cavity 108 may be perpendicular with respect to one another, as shown in the illustrative example of FIG. 1. In other embodiments, the longitudinal axis of sound cavity 104 may be aligned with the longitudinal axis of microphone cavity 108 (e.g., a single cavity extending through the noise mitigating microphone attachment can function as both microphone cavity and sound cavity, receiving a microphone at one end of the cavity and receiving sound at the other end of the cavity.)

A performance sound source may be placed proximate to opening 106 of sound cavity 104. For example, microphone attachment 100 may be positioned such that opening 106 is aligned with and facing the mouth of a vocalist. In another example, 106 may be positioned adjacent to an instrument. Typically, opening 106 would be placed at a location relative to the performance sound source similar to where a microphone would be placed for recording the performance sound source. Because microphones contain sensitive components, when the microphone lacks a protective covering, the microphone may be placed at a sufficient distance from a performance sound source in order to protect the microphone from damage. In this way, the microphone can be protected against accidental bumps by instruments or performers. The foam structure of noise mitigation microphone attachment may protect a microphone by providing impact resistance. Because the structure of noise mitigating microphone attachment 100 can protect the microphone from jarring or bumping, opening 106 of noise mitigating microphone attachment 100 can be placed closer to a performance sound source than a microphone would be placed without the attachment.

In some embodiments, a plurality of microphone attachments 100 may be used when performance sound is being captured. For example, when a collection of instruments, such as a collection of percussion instruments (e.g., a drum set), is used for a performance, a different microphone may be used to simultaneously record each instrument of the collection of instruments. A microphone attachment 100 may be used with each microphone. Opening 106 of sound cavity 104 for each microphone attachment of the plurality of microphone attachments may be positioned to face a different part of a drum set or other collection of instruments. In an illustrative example, a microphone can be placed in a "close-miked" position (e.g., 1 to 12 inches, such as 2 to 4 inches) relative to each drum of a drum set and a microphone can be placed in a close-miked position relative to each of one or more cymbals.

In another example, the performance of multiple performers may be captured with a plurality of microphones and an attachment 100 for each microphone. For example, if multiple microphones are used simultaneously to capture the performance of a musical group having one or more vocalists and/or one or more instrumentalists, an attachment 100 may be used with each microphone. Opening 106 of sound cavity 104 for each microphone attachment of the plurality of microphone attachments may be positioned to face each of (or groups of) the vocalists and/or instruments.

In a further embodiment, microphone attachment 100 may be used with a boom microphone or other microphone used to capture performance sound during video or other motion picture recording. A boom microphone is typically located at one end of a boom pole. The other end of the boom pole may be handled or otherwise managed by a boom operator. The boom microphone can be used to capture performance sound associated with an actor or action by placing the boom microphone in proximity to the actor or action but outside of a camera's frame. Opening 106 of sound cavity 104 may be positioned such that it faces the actor or action that is the sound source of interest.

Figure 2:
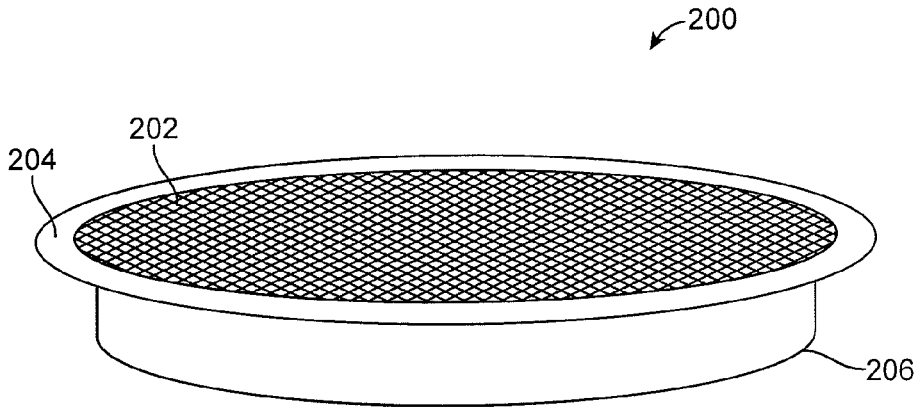
FIG. 2 shows an illustrative pop filter, according to an embodiment.

FIG. 2 shows a pop filter 200 that can be coupled to a noise mitigating microphone attachment, according to an embodiment. For example, pop filter 200 can be inserted into opening 106 of attachment of noise mitigating microphone attachment 100. A pop filter can be used to reduce and/or eliminate popping sounds caused when plosive sounds (such as sound that may occur when the letter "B" or "P" is pronounced) and sibilants (such as sound that may occur when the letter "S" or "Z" is pronounced) are recorded by a microphone. Pop filter 200 can include base 206 and lip 204. Base 206 and lip 204 can be metal, plastic, or other material. Base 206 and lip 204 can be fabricated as a single part. Lip 204 may extend beyond opening 106 over the surface of structure 102. Pop filter 200 can include mesh 202 extending across the area defined by the interior circumference of lip 204. Mesh 202 may be, e.g., a polyester, metal, or nylon mesh. It will be recognized that a variety of materials or structures could be used as a pop filter in conjunction with a noise mitigating microphone attachment.

Figure 3:
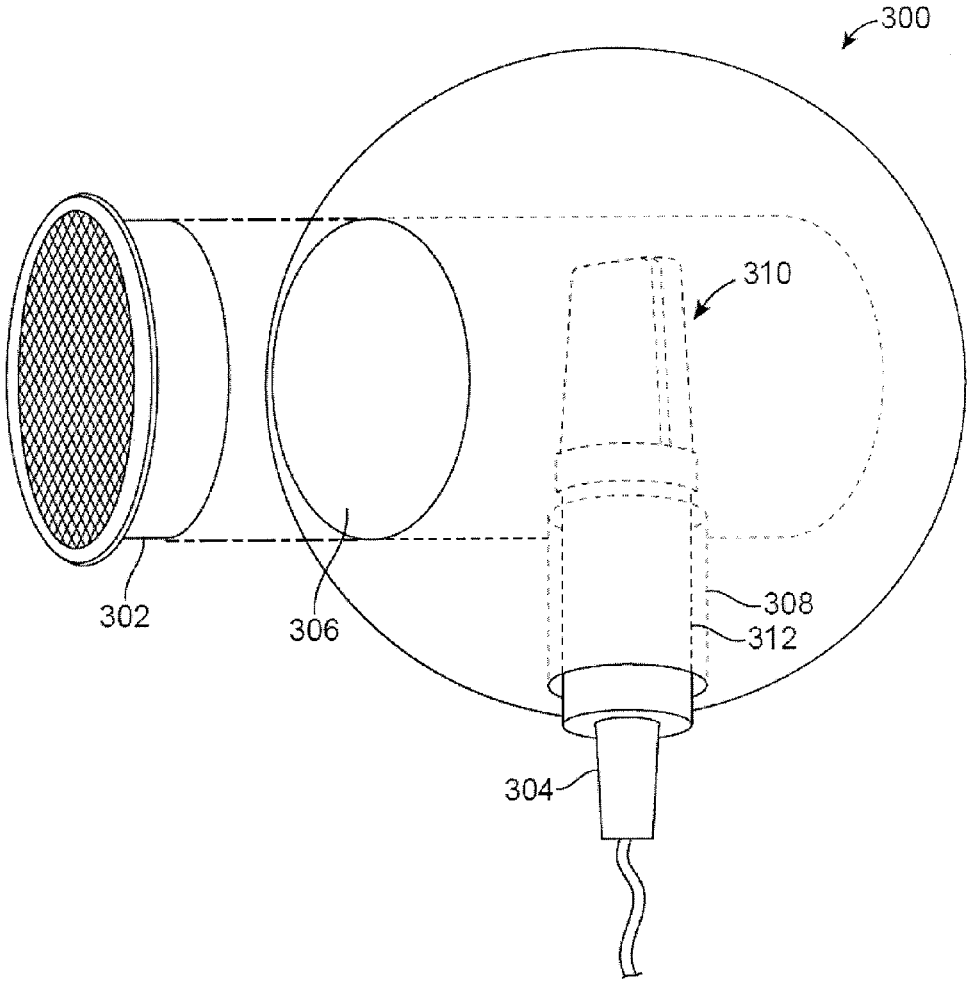
FIG. 3 illustrates the insertion of a pop filter and a microphone into an illustrative noise mitigating microphone attachment, according to an embodiment.

FIG. 3 illustrates the insertion of elements such as a pop filter and microphone into noise mitigating microphone attachment structure 300, according to an embodiment. Pop filter 302 may correspond to pop filter 200 described with reference to FIG. 2. Pop filter 302 can be inserted into opening 306 of structure 300. The material of structure 300 may be resilient such that pop filter can be inserted within opening 306 of structure 300 and held in place relative to structure 300 by the material of structure 300.

Microphone 304 can be inserted into microphone cavity 308 of noise mitigating microphone attachment 300. The material of structure 300 may be resilient such that different sizes of microphones can be accommodated by microphone cavity 308. In some embodiments, when microphone 304 is inserted into opening 308 of structure 300, the material of structure 300 elastically couples noise mitigating microphone attachment 300 to microphone 304. If a base of microphone 304 is too narrow to fit snugly within opening 308, an insert, such as a foam collar insert, may be placed around the microphone casing. In this manner, the diameter of the microphone base may be increased such that the microphone base can fit snugly within opening 308. When microphone 304 is inserted in opening 308, elastic coupling between the casing of microphone 304 (or a collar tightly secured around microphone 304) and opening 308 may form a seal. The seal can reduce the amount of noise that enters the sound cavity through the microphone cavity. In some embodiments, the elastic coupling between microphone 304 and opening 308 can allow the noise mitigating microphone attachment to be suspended from microphone 304 (i.e., as if FIG. 3 were rotated 180 degrees).

Microphone 304 can include sound receiving elements 310 and casing 312. Sound receiving elements 310 can include elements such as a capsule, diaphragm, protective elements, and the like. Microphone 304 can be any of a wide variety of microphones. The microphone type may be, for example, condenser, electret condenser, dynamic, etc. Typically, microphone 304 is a microphone designed for use in a recording studio environment, although it will be recognized that other microphones may be used. Microphone 304 may have any polar pattern, such as omnidirectional, cardioid, hypercardioid, supercardioid, etc.

The noise mitigating microphone attachment can improve the performance of an omnidirectional microphone for recording performance sound. As will be recognized by those skilled in the art, an omnidirectional microphone may be undesirable when a microphone is used for recording a performance from a particular sound source, such as a vocal performance, because the omnidirectional microphone will pick up sound arriving directly from the vocalist and sound from other directions (e.g., environmental noise and reflected sound from the performance sound source) approximately equally. In contrast, when a noise mitigating microphone attachment is used with an omnidirectional microphone, the noise mitigating microphone attachment receives direct performance sound via the sound cavity and can attenuate and/or absorb sound arriving from other directions.

Figure 4:
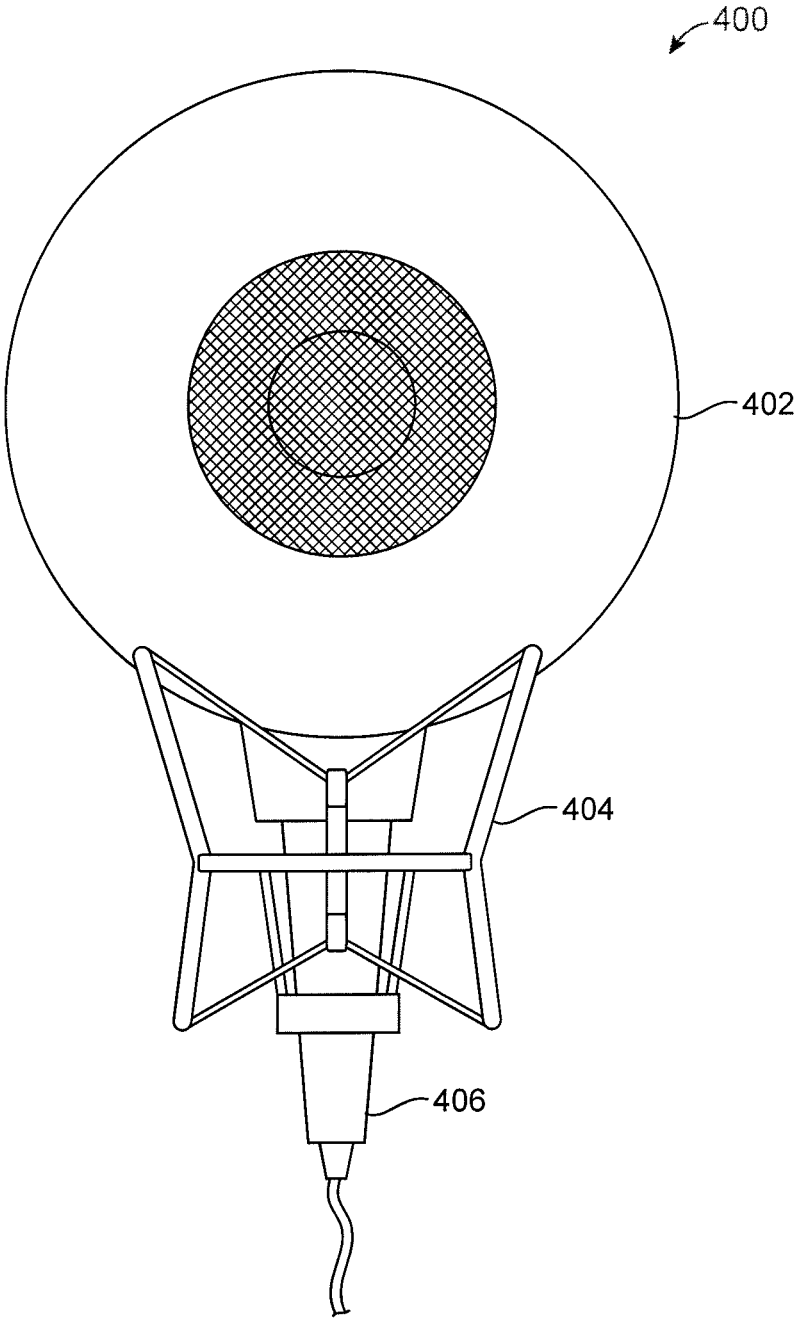
FIG. 4 is a front view of an illustrative noise mitigating microphone attachment shown seated in a shock mount, according to an embodiment.

FIG. 4 is a front view 400 of a noise mitigating microphone attachment shown seated in a shock mount, according to an embodiment. In some embodiments, noise mitigating microphone attachment 402 can be seated in a shock mount 404. A shock mount is a mechanical fastener that can suspend a microphone in elastics that are attached to a microphone stand such that transmission of vibrations from the microphone stand to the microphone is minimized. The shape of the noise mitigating microphone attachment allows it to be used with a microphone mounted in a shock mount. The noise mitigating microphone attachment can also be used with a microphone mounted directly to a microphone stand.

To mount noise mitigating microphone attachment 402 within shock mount 404, the noise mitigating microphone attachment 402 is seated within a cradle formed by the upper arms of shock mount 404. In this manner, the noise mitigating microphone attachment 402 is held in place relative to shock mount 404 by gravity.

Figure 5:
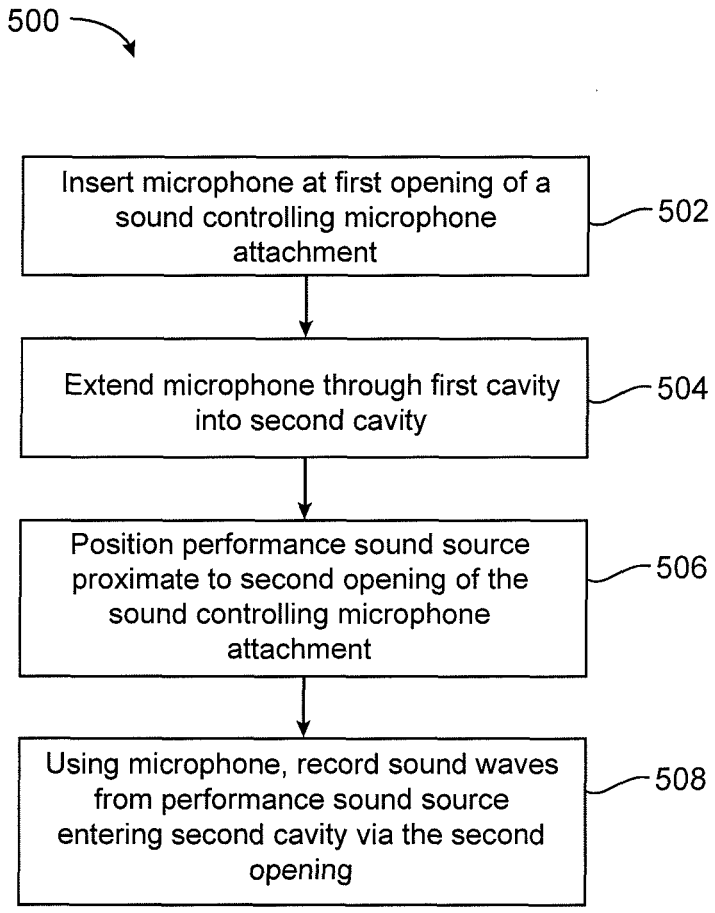
FIG. 5 is an illustrative flowchart of a process for mitigating noise during a recording with a noise mitigating microphone attachment, according to an embodiment.

FIG. 5 is a flowchart of a process 500 for channeling sound during a recording with a noise mitigating microphone attachment, according to an embodiment.

At block 502, a microphone can be inserted into a first opening, such as opening 110 of microphone cavity 108, of a noise mitigating microphone attachment 100. At block 504, the microphone can be extended through first cavity 108 into a second cavity, such as sound cavity 104, of the noise mitigating microphone attachment 100. At block 506, a performance sound source, such as the mouth of a vocalist, can be positioned proximate to a second opening, such as opening 106, of the noise mitigating microphone attachment. At block 508, the microphone can be used to record sound waves from the performance sound source that enter the second cavity via the second opening.

Figure 6:
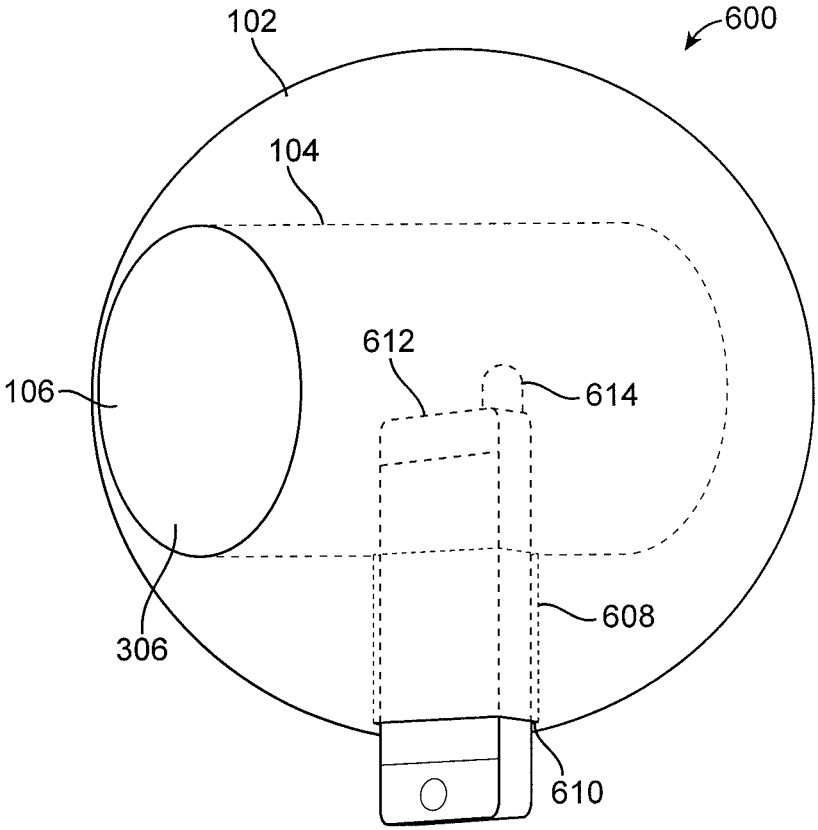
FIG. 6 shows an illustrative noise mitigating microphone attachment having a cavity configured to receive a mobile device.

FIG. 6 shows an illustrative microphone attachment 600 having a microphone cavity 610 with a rectangular profile. In some embodiments, microphone cavity 610 may be configured to receive a mobile device 612 with microphone attachment 614. Microphone cavity 610 may extend from an opening 610 at the surface of structure 102 and may intersect sound cavity 104.

Mobile device 612 may be a cellular phone, tablet, media player, or other handheld electronic device. Microphone 614 may be a microphone that is configured to couple physically and/or mechanically to a mobile device. For example, microphone 614 may couple to mobile device 612 via connector of the mobile device such as a USB, ⅛-inch, 30-pin or other connector. Microphone 614 can be, for example, a compact microphone such as Mini Mic by VeriCorder, Flexible Mini Capsule Microphone by Brando Workshop, or Mikey by Blue Microphones. Microphone cavity 610 may have a rectangular or other shape of cross-sectional area configured to receive a device having an attached microphone.

The embodiments described herein provide a portable device that can be produced at low cost relative to the cost of existing solutions for noise mitigation in recording environments. The noise mitigation microphone attachment can be used for sound recording in a home studio, outdoors, or other environment to protect a microphone from picking up unwanted sounds during a performance. A microphone can be inserted into a first opening of the noise mitigation microphone attachment and extend through a microphone cavity into a sound cavity. The sound cavity can extend from a second opening at the surface of the noise mitigating microphone attachment. A performance sound source is typically located proximate to the second opening. Sound incident on the exterior of the noise mitigating microphone attachment is attenuated by the structure of the noise mitigating microphone attachment.

While the invention has been described with respect to specific embodiments, one skilled in the art will recognize that numerous modifications are possible. Thus, although the invention has been described with respect to specific embodiments, it will be appreciated that the invention is intended to cover all modifications and equivalents within the scope of the following claims.

What is claimed is:

1. An attachment for a microphone, the attachment comprising:

a foam structure;

a first cavity extending from a first opening at a surface of the foam structure and into the foam structure, the first cavity configured to seal a mobile device into the first cavity such that a first portion of the mobile device is contained within the foam structure and a second portion of the mobile device is not contained within the foam structure, wherein the first cavity elastically couples the mobile device to the foam structure such that the foam structure is supportable by the mobile device;

a second cavity extending from a second opening at the surface of the foam structure and into the foam structure, the second opening configured to receive sound from a sound source, wherein the second cavity is a cylindrical-shaped cavity with a substantially uniform diameter along a longitudinal axis of the second cavity; and the first cavity being fluidly connected to the second cavity within the foam structure so that a junction is formed between the first cavity and the second cavity, the junction, the sound cavity, and the sealing of the mobile device working to shield the sound receiving elements of a microphone coupled to the mobile device from sound other than received through the second opening.

2. The attachment of claim 1, wherein the structure has a spherical shape.

3. The attachment of claim 1, wherein the structure is a foam structure.

4. The attachment of claim 3, wherein the foam structure is an open cell polyurethane foam.

5. The attachment of claim 1, wherein the first cavity has a rectangular cross-sectional area.

6. The attachment of claim 1, wherein a longitudinal axis of the first cavity extends perpendicular to a longitudinal axis of the second cavity.

7. The attachment of claim 1, further comprising an elastic coupling, wherein the foam structure is removably mountable to the mobile device by the elastic coupling between the first opening of the foam structure and the mobile device.

8. The attachment of claim 1, further comprising a pop filter coupled to the foam structure at the second opening, wherein a pop filter includes a mesh element.

9. The attachment of claim 8, wherein the pop filter is removably mounted to the foam structure by an elastic coupling between the pop filter and the second opening of the foam structure.

10. A method for mitigating noise, the method comprising:

receiving a mobile device through a first opening of a foam structure into a first cavity in the foam structure, such that a first portion of the mobile device is contained within the foam structure and a second portion of the mobile device is not contained within the foam structure, wherein the first cavity elastically couples the mobile device to the foam structure such that the foam structure is supportable by the mobile device, wherein a microphone coupled to the mobile device extends into a second cavity in the foam structure, the second cavity being fluidly connected to the first cavity within the foam structure and extending from a second opening at a surface of the foam structure;

receiving performance sound from a performance sound source via the second cavity; and attenuating, by the foam structure, sound waves incident on an exterior surface of the foam structure.

11. The method of claim 10, further comprising seating the foam structure in a cradle of a shock mount.

12. The method of claim 10, further comprising elastically coupling a pop filter to the foam structure at the second opening of the foam structure.

13. The method of claim 10, further comprising elastically coupling the mobile device to the foam structure at the first opening of the foam structure.

14. The method of claim 10, further comprising absorbing sound waves incident on an exterior surface of the foam structure.

15. The method of claim 10, further comprising attenuating sound waves incident on the interior surface of the sound cavity.

16. The attachment of claim 1, wherein the cylindrical-shaped cavity with a substantially uniform diameter provides even absorption of sound around the circumference and along the interior of the second cavity.

* * * * *